United States Patent [19]

Hosomi et al.

[11] Patent Number: 4,851,622

[45] Date of Patent: Jul. 25, 1989

[54] PUFFER TYPE GAS-BLAST CIRCUIT BREAKER

[75] Inventors: Mamoru Hosomi; Takashi Yonezawa, both of Amagasaki, Japan

[73] Assignee: Mitsubishi Denki Kabushiki Kaisha, Tokyo, Japan

[21] Appl. No.: 207,917

[22] Filed: Jun. 10, 1988

[30] Foreign Application Priority Data

Jun. 11, 1987 [JP] Japan ..... 62-90869[U]

[51] Int. Cl.[4] ..... H01H 33/88

[52] U.S. Cl. ..... 200/148 A; 200/148 B

[58] Field of Search ..... 200/148 A, 148 G, 148 B, 200/148 E

[56] References Cited

U.S. PATENT DOCUMENTS 3,909,572 9/1975 Tsubaki et al. ..... 200/148 A
3,946,183 3/1976 Milianowicz ..... 200/148 A
4,445,020 4/1984 Ueda et al. ..... 200/148 A
4,594,488 6/1986 Talpo ..... 200/148 A
4,736,080 4/1988 St Jean et al. ..... 200/148 A

*Primary Examiner*—Robert S. Macon
*Attorney, Agent, or Firm*—Lowe, Price, Leblanc, Becker & Shur

[57] ABSTRACT

In a puffer type gas-blast circuit breaker, a fixed arc contact (1) which has a hollow (1*a*) therein, with at least one vent (1*b*) on an end part thereof, stores a high pressure insulation gas which is heated and expanded by an arc formed between the fixed arc contact (1) and a moving arc contact (6) and is pressurized by passing through a nozzle (8) in an operation breaking a current, and after breaking of the current, the insulation gas stored in the hollow (1*a*) flows out of the vent (1*b*) and expands around the end part of the fixed arc contact; whereby a dielectric strength of the space around the end of the fixed arc contact (1) is strengthened so that reignition between the fixed arc contact (1) and the moving arc contact (6) is avoided.

7 Claims, 4 Drawing Sheets

PUFFER TYPE GAS-BLAST CIRCUIT BREAKER

FIELD OF THE INVENTION AND RELATED ART STATEMENT

1. Field of the Invention

The present invention relates to a puffer type gas-blast circuit breaker wherein an insulation gas compressed in a puffer chamber blasts and extinguishes an arc formed between a fixed arc contact and a moving arc contact in current-breaking operation.

2. Description of the Related Art

FIG. 4 is a cross-sectional view showing an opening operation by a main part of the conventional puffer type gas-blast circuit breaker. In this figure, a fixed arc contact 41 which has a rod-shaped configuration with a narrow end part and a fixed main contact 2 which has a substantially cylindrical configuration with plural slits 2*a* are coaxially fixed to a flange 43 in one side of an enclosure (not shown). Opposing to the fixed arc contact 41 and the fixed main contact 2, a moving arc contact 6, which has a substantially cylindrical configuration with plural slits 6*a*, and a moving main contact 7, which is integrally formed on an end of a puffer cylinder 9 and has a cylindrical configuration, are coaxially provided, respectively. A nozzle 8 which is made of a substantially cylindrical insulating material is held by the moving main contact 7 and surrounds a front side space of the moving arc contact 6. By moving the moving arc contact 6, moving main contact 7 and the puffer cylinder 9, which are linked with driving means (not shown) rightward/leftward of the figure, the moving arc contact 6 and the moving main contact 7 are connected/disconnected with a circumference of end part of the fixed arc contact 41 and an internal circumference of end part of the fixed main contact 2, respectively.

When the moving arc contact 6 is disconnected from the fixed arc contact 41, namely at the time of circuit breaker opening, an arc "A" is formed between the moving arc contact 6 and the fixed arc contact 41. At that time, a piston 10 which is fixed to a stationary part (not shown) and is disposed inside the puffer cylinder 9 to be movable relative thereto pushes an insulation gas present in the puffer cylinder 9 rightward in FIG. 4 and thereby the insulation gas is compressed and flowed into the nozzle 8. As a result, the arc "A" which is formed between the moving arc contact 6 and the fixed arc contact 41 is blown out by the insulation gas, i.e., the arc "A" is extinguished. The insulation gas which is blasted to the arc "A" and is heated thereby is exhausted out of a vent 43*a*, which is formed in the flange 43, through a hollow space formed in the fixed main contact 2.

In the above-mentioned conventional puffer type gas-blast circuit breaker, when there is not a sufficient gap between the nozzle 8 and the end of the fixed arc contact 41, the insulation gas which flows along the nozzle 8 as shown by an arrow 50 is heated to a high temperature and pressed to a high pressure in the nozzle 8 owing to a heating of the insulating gas by the arc "A" and a tapering of the inner surface of the nozzle 8. Thereafter, when the fixed arc contact 41 escapes relatively out of the nozzle 8, the insulation gas in the nozzle 8 pours out of the nozzle 8, and the density of the insulation gas in the nozzle 8 is thereby rapidly lowered. This density-lowering of the insulation gas reduces an arc conductance after zero-point of current and makes an interruption, which is a thermal interruption the timing of which is determined by a simple relationship between an arc energy, represented by a product of an arc voltage by an arc current, and a cooling capacity of the blasted insulation gas. Therefore, several designs have been developed to efficiently exhaust the high temperature and high pressure insulation gas in the nozzle 8. However, when the fixed arc contact 41 is far enough from the nozzle 8 as to form an open space in front thereof, the insulation gas rapidly flows out of the nozzle 8, and thereby a density of the insulation gas around the end part of the fixed arc contact 41 is greatly lowered.

After the arc "A" is extinguished, a transient recovery voltage appears between the fixed arc contact 41 and the moving arc contact 6, and a high potential electric field is formed around the end parts of the fixed arc contact 41 and moving arc contact 6. At that time an insulation between the fixed arc contact 41 and the moving arc contact 6, namely inter-pole insulation, may not sufficiently withstand the transient recovery voltage. Therefore, dielectric breakdown, namely a failure of interruption, may occur between the fixed arc contact 41 and the moving arc contact 6.

OBJECT AND SUMMARY OF THE INVENTION

An object of the present invention is to offer a puffer type gas-blast circuit breaker wherein an inter-pole withstand voltage against a transient recovery voltage after breaking current is improved without lowering of breaking ability.

The above-mentioned object is achieved by a puffer type gas-blast circuit breaker in accordance with the present invention, which comprises:

a first contact which has a hollow for temporarily holding a quantity of pressurized insulation gas therein and has at least one vent communicating with the hollow at a first end part thereof the hollow being substantially closed except for said vent, a second contact which moves relative to the first contact on the same axis for connecting/disconnecting with the first end part of the first contact; and insulation gas supply means for blasting an insulation gas to an arc which is formed upon disconnection of the first contact from the second contact to extinguish the arc.

By adopting the above-mentioned construction, an inter-pole dielectric strength between a fixed arc contact (the first or second contact) and a moving arc contact (the second or first contact) is improved against a transient recovery voltage which is generated just after current-breaking, and thereby a puffer type gas-blast circuit breaker which is usable for high voltage circuit and has a large interrupting capacity is provided.

DESCRIPTION OF THE PREFERRED EMBODIMENTS

A preferred embodiment of the present invention is now described with reference to the accompanying drawings.

Figure 1:
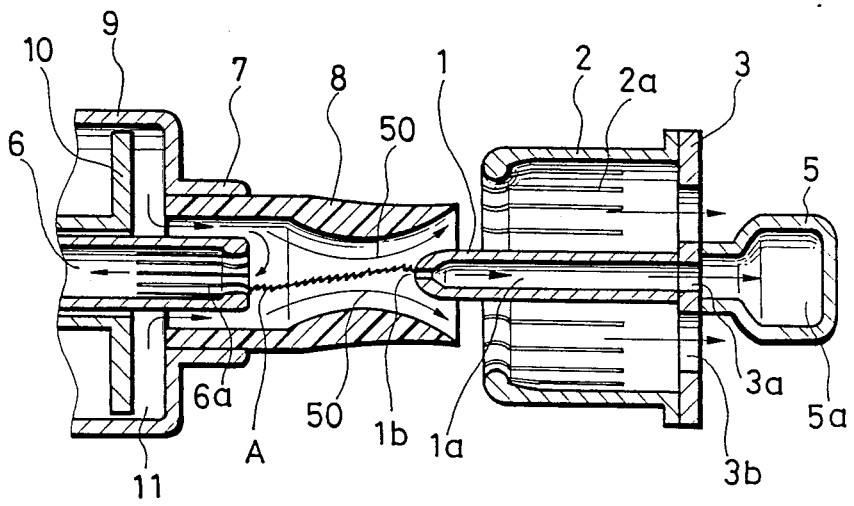
FIG. 1 is a partial cross-sectional view showing a preferred embodiment of a puffer type gas-blast circuit breaker in accordance with the present invention.

FIG. 1 is a cross-sectional view of a preferred embodiment showing an opening operation by main parts in a stationary enclosure (not shown) of a puffer type gas-blast circuit breaker according to this invention. A fixed part comprises a flange 3, which has a disk-shaped configuration with a vent 3*a* at the center thereof and plural vents 3*b* around the vent 3*a*, and a fixed arc contact 1, which has a cylindrical trunk part with a hollow 1*a* therein and a narrow end part with a vent 1*b* thereon. The fixed arc contact 1 is coaxially fixed on a bank (namely the flange 3) of the vent 3*a* so as to connect the hollow 1*a* with the vent 3*a*.

A fixed main contact 2, which has a substantially cylindrical configuration with plural slits 2*a*, is also coaxially fixed on the flange so as to surround the plural vents 3*b*. In the other side (rightward of the figure) of the flange 3, a housing 5 is coaxially fixed on a bank (namely the flange 3) of the vent 3*a* so as to connect a chamber 5*a* formed in the housing 5 with the vent 3*a*.

A movable part comprises a moving arc contact 6, which has a substantially cyclindrical configuration with plural slits 6*a*, and a moving main contact 7, which is integrally formed on an end of a puffer cylinder 9 and has a cylindrical configuration. The moving arc contact 6 and the moving main contact 7 are coaxially disposed to oppose to the fixed arc contact 1 and the fixed main contact 2, respectively. A nozzle 8, which is preferably made of a substantially cylindrical insulating material is held by the moving main contact 7 and surrounds in front of the moving arc contact 6. By moving the moving arc contact 6 and the puffer cylinder 9, which are linked with driving means (not shown), rightward/leftward of the figure, the moving arc contact 6 and the moving main contact 7 are connected/disconnected with a circumference of the end part of the fixed arc contact 1 and an internal circumference of the end part of the fixed main contact 2, respectively.

When the moving arc contact 6 and the moving main contact 7 move from a connected position to a disconnected position (namely move leftward of the figure) together with the puffer cylinder 9, a piston 10, which is disposed inside the puffer cylinder 9 and is fixed to a stationary part (not shown), relatively pushes the insulation gas in the puffer cylinder 9 rightward of the figure. An insulation gas in the puffer cylinder 9 is thereby compressed and flows into the nozzle 8, as indicated by arrow 50. As a result, an arc "A" which forms between the moving arc contact 6 and the fixed arc contact 1 is blown out by the insulation gas. Thus, the arc "A" is extinguished. After that, the insulation gas flows between the fixed main contact 2 and the fixed arc contact 1 and is exhausted from the vents 3*b* to a rear side (rightward of FIG. 1) of the flange 3.

Hereupon, when there is not a sufficient gap between the nozzle 8 and the fixed arc contact 1, the insulation gas in the nozzle 8 attains an extremely high pressure, owing to a tapering of the inner surface of the nozzle 8 and expansion due to heating of the gas by the arc "A". Therefore, a part of the insulation gas flows into an inside of the moving arc contact 6, and another part thereof flows through the vent 1*b* into the hollow 1*a* and the chamber 5*a* and is stored therein.

When the nozzle 8 has moved far enough from the fixed arc contact 1 so that there is a large space in front of an end of nozzle 8, high pressure insulation gas in the nozzle 8 pours out therefrom, and the pressure of the insulation gas in the nozzle 8 thereby rapidly lowers. Subsequently thereafter, the insulation gas stored in the passage 1*a* and the chamber 5*a*, flows contrarily out of the vent 1*b* and expands around the end part of the fixed arc contact 1. Therefore, the density of the insulation gas around the end part of the fixed arc contact 1 is raised after current-breaking, so that a reignition of the arc by the transient recovery voltage is avoided.

Generally, in the above-mentioned state, at the end part of the fixed arc contact 1 the electric field is higher than that of the other metal surface, and the density of the insulation gas around the end part of the fixed arc contact 1 is lower than at other parts of the device. Dielectric breakdown after current-breaking is therefore liable to occur at the end part of the fixed arc contact 1. Therefore, although the capacities of the hollow 1*a* and the chamber 5*a* are not large and the quantity of insulation gas which flows out of the vent 1*b* is quite small, the dielectric strength at the end of fixed arc contact 1 is remarkably improved thereby.

Figure 2:
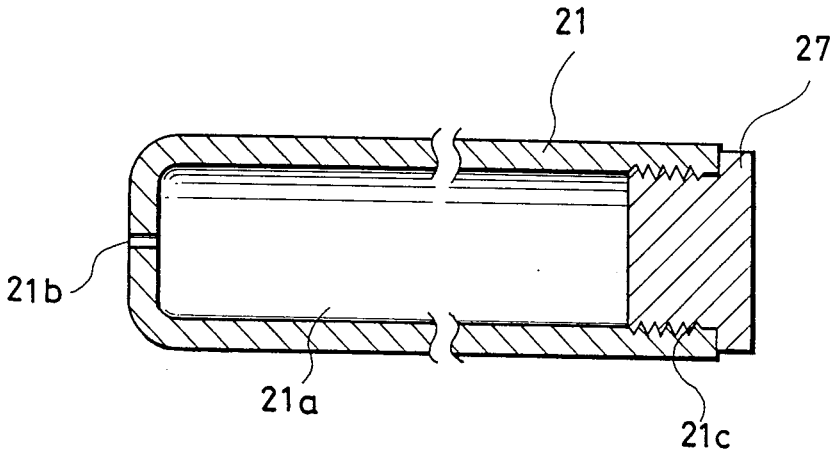
FIG. 2 is a cross-sectional view showing another embodiment of a fixed arc contact in a puffer type gas-blast circuit breaker in accordance with the present invention.

FIG. 2 is a cross-sectional view showing another embodiment of a fixed arc contact. This fixed arc contact 21 has a cylindrical configuration with a hollow 21*a* and has a small cylindrical vent 21*b* on a closed end thereof. On an inner surface of another open end of the fixed arc contact 21, a screw thread 21*c* is formed and a plug 27 is screwed thereat. The thread 21*c* and the plug 27 together serve to block the open end of contact 21.

Figure 3:
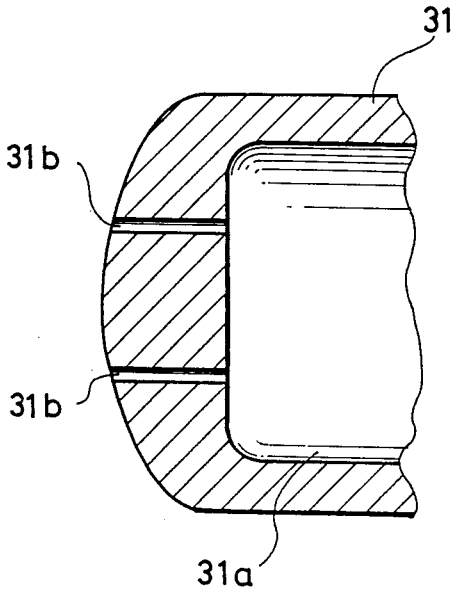
FIG. 3 is a partially enlarged cross-sectional view showing still another embodiment of a fixed arc contact in a puffer type gas-blast circuit breaker in accordance with the present invention.
Figure 4:
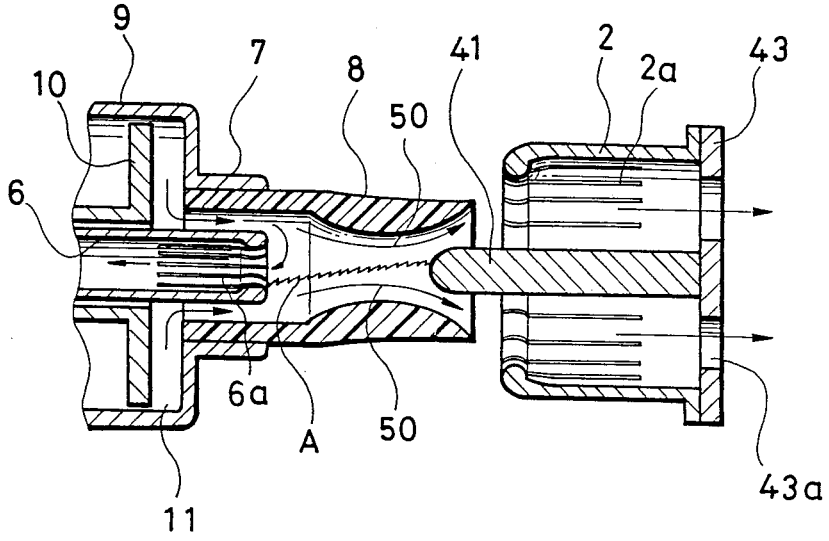
FIG. 4 (Prior Art)
FIG. 4 is a partial cross-sectional view showing the conventional puffer type gas-blast circuit breaker.

FIG. 3 is a partially enlarged cross-sectional view showing still another embodiment of a fixed arc contact. This fixed arc contact 31 has a cylindrical configuration with a hollow 31*a* and a spherical end surface. Plural cylindrical vents 31*b* (two of them are shown in the figure) are formed between around the center of the spherical end surface and the hollow 31*a*. Other parts are substantially the same as shown in FIG. 1.

In the above-mentioned three embodiments, although the vents 1*b* (FIG. 1), 21*b* (FIG. 2) and 31*b* (FIG. 3) are formed at the center or near the center of the end surface of the fixed arc contacts 1 (FIG. 1), 21 (FIG. 2) and 31 (FIG. 3), respectively, it is desirable to form those vents at about the position where an intensity of the electric field on the fixed arc contact 1 (FIG. 1), 21 (FIG. 2) or 31 (FIG. 3) is maximum. Furthermore, plural vents can be formed not only in the fixed arc contact 31 (FIG. 3) but also in the fixed arc contacts 1 (FIG. 1) and 21 (FIG. 2). Then, one of the plural vents (for instance 31*b*) may have a larger diameter than those of others and be provided a check valve (not shown) therein, in order that only flowing-in of the insulation gas is permitted. Furthermore, hollows alike in the hollows 1*a* (FIG. 1), 21*a* (FIG. 2) and 31*a* (FIG. 3) can be formed in the moving arc contact 6 (FIG. 1) instead of the fixed arc contact 1 (FIG. 1), 21 (FIG. 2) or 31 (FIG. 3).

While specific embodiments of the invention have been illustrated and described herein, it is realized that other modifications and changes will occur to those skilled in the art. It is, therefore, to be understood that the appended claims are intended to cover all modifications and changes as fall within the true spirit and scope of the invention.

What is claimed is:

1. A puffer type gas-blast circuit breaker, comprising:

a first contact, which has a hollow for temporarily holding a quantity of pressurized insulation gas therein and at least one vent communicating with the hollow at a first end part of the first contact, said hollow being substantially closed except for said vent;

a second contact which moves relative to said first contact on the same axis for connecting/disconnecting with said first end part of the first contact; and insulation gas supply means for blasting an insulation gas to an arc which is formed upon disconnection of said first contact from said second contact to extinguish said arc.

2. A puffer type gas-blast circuit breaker in accordance with claim 1, further comprising:

a closed chamber connected to communicate only with said hollow through a second end part of said first contact, for temporarily storing an amount of said blasting insulation gas received therein through said at least one vent and said hollow to subsequently spout the insulation gas out of said first end part of the first contact.

3. A puffer type gas-blast circuit breaker in accordance with claim 1, wherein:

said at least one vent is located in said first contact at a position where an intensity of electric field around said end part of the first contact is maximum.

4. A puffer type gas blast circuit breaker according to claim 1, wherein:

said hollow in said first contact is formed with an open end that is plugged close.

5. A puffer type gas blast circuit breaker according to claim 1, wherein:

a plurality of vents is provided, including said at least one vent, and one of said plural vents has a diameter larger than the diameters of the other vents.

6. A puffer type gas blast circuit breaker according to claim 5, further comprising:

a check valve for ensuring that the flow of said insulating gas is directed only into said hollow therethrough.

7. A puffer type gas blast circuit breaker according to claim 1, wherein:

said first contact is a fixed contact and said second contact is a movable contact connected to means for moving the same.

* * * * *